United States Patent [19]

Oder et al.

[11] 4,078,998

[45] Mar. 14, 1978

[54] MAGNETIC SEPARATOR

[76] Inventors: Robin Roy Oder, Macon; Willie Jefferson Hatfield, Jr., Cochran, both of Ga.

[21] Appl. No.: 574,654

[22] Filed: May 6, 1975

Related U.S. Application Data

[63] Continuation of Ser. No. 516,544, Oct. 21, 1974, abandoned, which is a continuation of Ser. No. 263,348, Jun. 8, 1972, abandoned.

[51] Int. Cl.[2] ..... B03C 1/02

[52] U.S. Cl. ..... 209/223 R; 209/232; 210/222

[58] Field of Search ..... 209/213, 214, 222, 223, 209/232; 210/222, 223; 336/229

[56] References Cited

U.S. PATENT DOCUMENTS

| | | | |
|---|---|---|---|
| 1,948,419 | 2/1934 | Granigg | 210/222 X |
| 2,227,775 | 5/1942 | Mueller | 336/229 X |
| 2,511,230 | 6/1950 | Wald | 336/229 X |
| 2,590,743 | 5/1952 | Vermieren | 210/222 |
| 2,926,784 | 3/1960 | McNaught | 209/213 |
| 2,951,586 | 9/1960 | Moriya | 210/223 |
| 3,289,836 | 12/1966 | Weston | 209/222 X |
| 3,567,026 | 3/1971 | Kolm | 210/222 |
| 3,627,678 | 12/1971 | Marston | 209/214 UX |
| 3,757,948 | 9/1973 | Tikhonov | 210/223 |

FOREIGN PATENT DOCUMENTS

| | | | |
|---|---|---|---|
| 557,626 | 11/1943 | United Kingdom | 210/223 |
| 691,388 | 5/1953 | United Kingdom | 210/223 |
| 319,325 | 4/1970 | U.S.S.R. | 210/222 |

*Primary Examiner*—Robert Halper

[57] ABSTRACT

An improved magnetic separator for effecting high efficiency collection of magnetics contained in solution and slurries. The separator comprises an enclosed magnet space having inlet and outlet ports for flowing therethrough of the slurry to be treated, a porous ferromagnetic material contained in the space, and means to establish in the space a magnetic field by a closed magnetic circuit, the lines of force of which are substantially all contained within the said magnet space.

3 Claims, 4 Drawing Figures

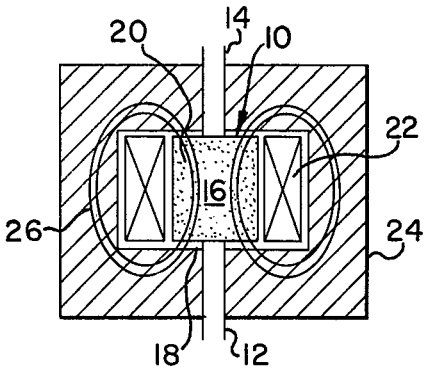
FIG. 1
PRIOR ART
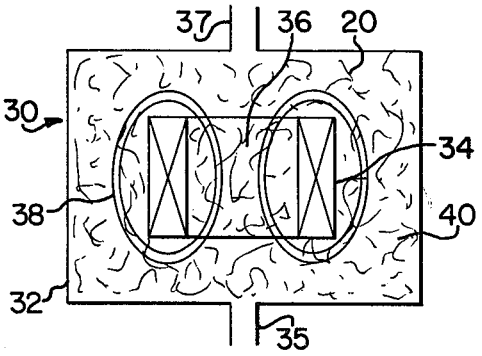
FIG. 2
FIG. 3
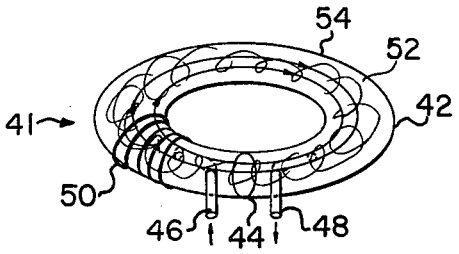
FIG. 4
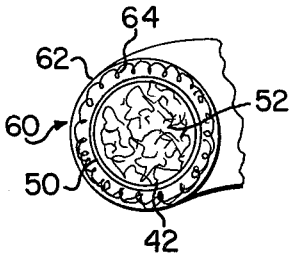

MAGNETIC SEPARATOR

REFERENCE TO RELATED APPLICATIONS

This is a continuation of application Ser. No. 516,544 non abandoned, filed Oct. 21, 1974, which in turn is a continuation of Ser. No. 263,348, filed June 8, 1972, now abandoned.

BACKGROUND OF THE INVENTION

This invention relates generally to the technology of magnetic separation and more specifically relates to apparatus useful in magnetically removing attractable components from solutions and slurries.

In the co-pending application of Joseph Iannicelli, U.S. Ser. No. 19,169, filed Mar. 13, 1970, and assigned to the assignee of the present application, there is disclosed magnetic separator apparatus which obviates many of the problems of the prior technology.

In particular there is disclosed therein magnetic separating apparatus which includes a non-magnetic cannister having inlet and outlet ports for flow through the slurry to be treated therein, the said cannister containing a mass of filamentary ferromagnetic material or the like as a collection matrix and, in some instances, being provided with baffling means for effecting an appropriate flow through the cannister. The cannister is surrounded by a suitable wire coil intended to provide an intense magnetic field in the vicinity of the said collection matrix. In accordance with conventional practice of magnetics technology, a solid ferromagnetic yoke surrounds both the cannister and the coil to provide a suitable low reluctance return path for the closed magnetic circuit including the cannister, magnet volume and the said solid portions of the yoke.

While a construction as above set forth is particularly effective in providing high intensity fields in the magnet space of the cannister, the actual volume within which treatment of the slurry may be provided as compared to the total separator volume is very limited. While the magnetic field is thus very intense within this small separation zone, the total magnetic field, if by such term we include the return portions of the magnetic circuit, actually extends far beyond the cannister space, and in fact the great bulk of the field as thus defined passes through the return circuit via the aforementioned yoke, in which latter return portions of the circuit no useful separating function is performed.

In accordance with the foregoing it may be regarded as an object of the present invention to provide a magnetic separator wherein the magnet volume effecting separation of magnetics from a solution or slurry treated therein, is of greatly increased dimensions and includes substantially all portions of the closed magnetic circuit providing the separation function.

It is a further object of the present invention to provide contained shapes for use in magnetic separating apparatus, which are ideally adapted for containing the totality of the magnetic field established by a coil associated therewith, and which are particularly adapted for efficient flow-through of solutions and slurries or the like to be treated therein.

It is another object of the invention to provide magnetic separation apparatus including, for the collection of magnetics, a matrix array which incorporates means which serve both to introduce tortuous flow into the slurry passing therethrough, and to concentrate magnetic flux at myriad collection points in such flow path, thereby fostering high efficiency in the collection process.

It is a further object of the present invention to provide a magnetic separator in which the collection matrix and the return path are indistinguishable from one another and the effective volume available for magnetic separation is thereby greatly increased over conventional iron return magnets.

SUMMARY OF THE INVENTION

Now in accordance with the present invention the foregoing objects, and others as will become apparent in the course of the ensuing specification, are achieved in magnetic separation apparatus including an enclosed magnet space having inlet and outlet ports for passage therethrough of solutions and slurries of clay or similar materials to be treated by the separation process. Electro-magnet means are provided and so disposed with respect to the enclosed magnet space that a closed magnetic circuit is established in the said space with substantially all lines of force defining the magnetic field being contained within the space.

In one embodiment of the invention, the magnet space may be defined by a simple non-magnetic cannister having inlet and outlet ports at the opposite ends thereof. A coil representing the source of the magnetic field is disposed within the cannister which is packed throughout with porous ferromagnetic material, as for example, various forms of steel wool. The magnetic field produced by the coil, both with the respect to the axial field passing therethrough and the return circuit established through the surrounding steel wool, is substantially all contained within the cannister. In consequence the cannister may be of considerable dimension and yet have all elements of the packed ferromagnetic material influenced by the said magnetic field.

In a further embodiment of the invention, the magnet space may comprise a hollow toroid with the field source being provided by a coil wrapped continuously about the said toroidal body. Non-magnetic baffles are arranged transverse to the flow direction through the toroid with the inlet and outlet ports being disposed at opposite sides of the barrier so that complete flow through, that is, around the toroid, is enabled. The toroid, as is the case for the cannister referred to, is packed with a suitable porous ferromagnetic material.

BRIEF DESCRIPTION OF THE DRAWINGS

The invention is diagrammatically illustrated by way of example in the drawings appended hereto in which:

FIG. 1 is a diagrammatic cross-section through a prior art separator device based upon a ferromagnetic material packed cannister;

FIG. 2 is a diagrammatic cross-section through a cannister incorporating the basic features of the present invention;

FIG. 3 is a schematic perspective view of an embodiment of a separator in accordance with the invention based upon toroidal geometry; and FIG. 4 is a diagrammatic cross-sectional representation of a further embodiment based upon toroidal geometry.

DESCRIPTION OF PREFERRED EMBODIMENT(S)

In order to fully appreciate the novel features of the present invention it is initially of interest to examine FIG. 1 herein setting forth in highly diagrammatic fashion a prior art construction utilizing a packed cannister element to effect separation of magnetics from a clay slurry or similar slurry or solution. The cannister 10 shown in FIG. 1 is an enclosed hollow body defined by walls 18 and having inlet and outlet ports at 12 and 14, respectively, for enabling the slurry or the like to be treated in the cannister, to be passed therethrough. The cannister defines internally a magnet space 16 which is filled with a porous ferromagnetic material 20, as for example steel wool, stainless wool, a porous ferrite or the like. In accordance with the principles of the prior art, as examplified for example in the co-pending Iannicelli application previously referred to, the cannister is seen to be surrounded firstly by a coil 22, which represents the source of the magnetic field utilized in the separation process, and is further surrounded by a solid ferromagnetic yoke 24.

In accordance with the well-known principles of electro-magnetics, the electro-magnetic field is established by furnishing a current to coil 22, in consequence of which an intense field is provided within axial reaches of the coil, more particularly within magnet space 16. The yoke 24 then provides a return path enabling a complete closed magnetic circuit consisting of the porous ferromagnetics 20 and portions of yoke 24 abounding the opposite ends of the cannister and the sides thereof. Such complete magnetic circuit is indicated by the lines of force designated at reference numeral 26 which thus represents the magnetic flux present in the device.

In connection with FIG. 1 it will be appreciated that while the arrangement permits a most intensive field to be established within the magnet space 16, which then in accordance with principles set forth in the aforementioned co-pending application, provides an efficient separation of magnetic impurities from the slurry or solution, it will, nevertheless, be clear that the actual space available for treatment of the slurry is relatively limited indeed. In point of fact the surrounding yoke commonly comprises the bulk of the apparatus and the treatment zone per se is thus correspondingly limited.

In FIG. 2 herein a schematic cross-sectional view appears which in mode of presentation is somewhat similar to FIG. 1, except that the apparatus depicted therein incorporates the features of the present invention. In particular a cannister 30 is now shown which is seen to be defined by an outer wall 32 of non-magnetic material, as for example, copper, stainless steel or the like. Cannister 30 is provided with an inlet port at 35 and outlet port 37 respectively, at the top and bottom of the cannister. The coil 34 is mounted centrally within the cannister 30 and provides the source for the magnetic field present therein. Packed about the coil 34 as well as within the axial zone 36, and thus completely filling the space defined within the walls 32, is a porous ferromagnetic material, 20, as for example steel wool or a porous ferrite.

It will now be appreciated by examining FIG. 2 and comparing the apparatus therein with FIG. 1, that the magnetic field in FIG. 2 as defined by the lines of force 38 indicating the flux density, is now substantially completely contained within the cannister 30. In particular it will be clear from examining the lines of force 38 that the magnetic circuit present in the cannister 30, is such that not only the axial portion of the magnetic field contained within zone 36, within the cannister 32, but similarly the return path for the circuit, as for example in the volume 40, is substantially all present within the said cannister.

The direction of the field relative to the flow is not of overriding importance and magnetic separations will be obtained in all areas of the device.

It will thus be clear that an enormously augmented volume is present in FIG. 2 as compared to FIG. 1, which is to say that a greatly increased volume has now been provided wherein a magnetic field is established for the separation process effected in the cannister 30.

It should, of course, be appreciated in this connection that the intensity of the field throughout the volume of cannister 30 is somewhat reduced as compared to the intensity within the magnet space 16 of FIG. 1; however, fields having an average intensity in excess of 2000 gauss are readily obtainable and since the removal of magnetics is a function not only of the field intensity but more particularly of field gradient and of the time of retention as well, it will be clear that the greatly increased volume present in the FIG. 2 apparatus vis-a-vis that in FIG. 1 will bring the average retention time to a point where efficient separation is still fully achieved.

In FIG. 3 a perspective schematicized view appears of an alternate embodiment of magnetic separator in accordance with the present invention. The separator 41 as shown therein comprises a hollow toroid which is provided with a baffle 44 cutting across the toroidal volume. An inlet port 46 and an outlet port 48 connect respectively to the toroidal volume on opposite sides of the baffle 44 so that the solution, slurry or the like may be flowed completely about the toroid volume by entering through inlet 46 at one side of baffle 44, proceeding about the toroid volume and exiting via outlet port 48. In the present instance the toroid body of 42 may once again be formed by a shall comprising a non-magnetic material, as for example, copper, stainless steel, plastics or so forth. In accordance with the present invention the toroid is wrapped with windings 50 which extend completely about the said body. These windings 50 serve as a source for the magnetic field utilized in accordance with the invention.

The hollow toroid body 42 as with the case of the prior embodiment of FIG. 2, is filled with porous ferromagnetic material 52, as for example steel wool or a porous ferrite. Under these conditions, and as is well known to those familiar with the science of electromagnetics, when current is suitably applied to the windings 50, the resultant magnetic field, as suggested by the lines of force 54, is substantially contained in its entirety within the toroid, which is to say that the magnetic flux proceeds in a simple closed circuit maintained within the torroid body.

Of course it should be appreciated in this connection that depending upon the reluctance of the return path, closeness of the winding spacings, and similar factors, a minute degree of flux leakage can of course occur from the main magnetic field contained within the toroid; however, as indicated such leakage is essentially nonconsequential.

If it is desired to employ even this leakage field for separation, this may be accomplished as shown in FIG. 4 by following the teachings of the FIG. 2 apparatus and surrounding toroid 42 and coils 50 with a larger concentric toroid 60 of non-magnetic material 62 and having its interior packed with porous ferromagnetic material 64. Suitable inlet and outlet means and baffles as taught in connection with FIG. 3 are, of course, required for the outer toroid as well.

The result of both of the foregoing arrangements is that slurry materials passing through the toroid body 42 in the manner indicated are subjected to a magnetic field for the entire course of the passage through the device 41, which furthermore can clearly encompass comparatively very large volumes particularly vis-a-vis the apparatus of the prior art which has been heretofore discussed.

While the present invention has been particularly set forth the terms of specific embodiments thereof it will be appreciated in view of the instant disclosure that numerous variations upon the invention are now enabled to those skilled in the art which variations in propriety yet reside within the scope of the instant teaching. Accordingly, the invention is to be broadly construed and limited only by the scope and spirit of the claims now appended hereto.

What is claimed is:

1. A magnetic separator for removing magnetics from clay slurries or the like passed therethrough comprising in combination:

an enclosed magnet space defined by a hollow cannister, the walls of which comprise a non-magnetic material, said cannister being packed with porous ferromagnetic material throughout selected from the group consisting of steel wool, stainless steel wool, and porous ferrites, said cannister being provided with inlet and outlet ports at respectively opposite ends thereof for flow-through of the said slurry; and electro-magnetic means for establishing within said space a magnetic field defined by a closed magnetic circuit, the lines of force of which are substantially all contained within said enclosed space, said means for establishing said magnetic field comprising a coil mounted within said cannister and surrounded by said ferromagnetic material, whereby the current provided to said coil effects said magnetic field contained within said cannister.

2. A magnetic separator for removing magnetics from clay slurries or the like passed therethrough comprising in combination:

an enclosed magnet space comprising a hollow toroidal body packed with ferromagnetic material and having inlet and outlet ports for passing said slurry through said space; and electro-magnetic means for establishing within said space; a magnetic field defined by a closed magnetic circuit the lines of force of which are substantially all contained within said enclosed space, said means to establish said magnetic field comprising a coil wrapped about said toroid, whereby current supplied to said coil effects a magnetic field circuitously about the interior of said toroid;

said toroid includes a transverse baffle and inlet and outlet ports respectively connected to the volume of said toroid at opposite sides of said baffle, whereby said slurry may be flowed through the entire volume of said toroid by passing said slurry into said inlet port, about said toroid body, and out said outlet port.

3. A magnetic separator for removing magnetics from clay slurries or the like passed therethrough comprising in combination:

an enclosed magnet space comprising a hollow toroidal body packed with ferromagnetic material and having inlet and outlet ports for passing said slurry through said space; and electro-magnetic means for establishing within said space; a magnetic field defined by a closed magnetic circuit the lines of force of which are substantially all contained within said enclosed space, said means to establish said magnetic field comprising a coil wrapped about said toroid, whereby current supplied to said coil effects a magnet field circuitously about the interior of said toroid;

said coil is enclosed within a second concentric toroidal body packed with ferromagnetic material.

* * * * *